US005308068A

United States Patent [19]

Strand

[11] Patent Number: 5,308,068

[45] Date of Patent: May 3, 1994

[54] GOLF PUTTER

[76] Inventor: Allan M. Strand, 4615 W. 28th St., St. Louis Park, Minn. 55416

[21] Appl. No.: 88,326

[22] Filed: Jul. 7, 1993

[51] Int. Cl.[5] ..... A63B 53/02

[52] U.S. Cl. ..... 273/164.1; 273/80 C; 273/167 G; 273/167 F

[58] Field of Search .... 273/77 R, 164.1, 167 R–77 A, 273/193 R, 194 R, 187.4, 80 C, 186.2

[56] References Cited

U.S. PATENT DOCUMENTS

| | | | |
|---|---|---|---|
| D. 202,715 | 11/1965 | Solheim . | |
| D. 207,228 | 3/1967 | Solheim . | |
| D. 213,509 | 3/1969 | Solheim . | |
| D. 231,375 | 4/1974 | Solheim | 273/80 C X |
| D. 234,784 | 4/1975 | Mills . | |
| 2,146,048 | 2/1939 | Barnhart | 273/80 C |
| 2,478,468 | 8/1949 | Drake . | |
| 3,062,549 | 11/1962 | Duden | 273/267 F X |
| 3,064,975 | 11/1962 | Smith . | |
| 3,166,320 | 1/1965 | Onions | 273/80 C |
| 3,462,155 | 8/1969 | Pelz | 273/80 C |
| 3,923,308 | 12/1975 | Mills . | |
| 3,954,265 | 5/1976 | Taylor | 273/80 C |
| 3,967,826 | 7/1976 | Judice . | |
| 3,989,257 | 11/1976 | Barr | 273/164.1 X |
| 4,140,318 | 2/1979 | Izett et al. . | |
| 4,227,694 | 10/1980 | Drake | 273/164.1 |
| 4,325,553 | 4/1982 | Taylor . | |
| 4,411,429 | 10/1983 | Drew | 273/164.1 |
| 4,508,342 | 4/1985 | Drake . | |
| 4,629,193 | 12/1986 | Pierman . | |
| 4,688,798 | 8/1987 | Pelz | 273/80 C X |
| 4,693,478 | 9/1987 | Long | 273/80 C X |
| 4,702,477 | 10/1987 | Solomon | 273/171 X |
| 4,722,528 | 2/1988 | Tsao . | |
| 4,741,535 | 5/1988 | Leonhardt . | |
| 4,747,599 | 5/1988 | Antonious . | |
| 4,898,387 | 2/1990 | Finney . | |
| 4,921,253 | 5/1990 | Tesori . | |
| 4,948,140 | 8/1990 | Antonious . | |
| 4,960,279 | 10/1990 | Harris, Jr. . | |
| 4,984,799 | 1/1991 | Finney . | |
| 4,999,000 | 3/1991 | Finney . | |
| 5,004,237 | 4/1991 | Antonious . | |
| 5,014,992 | 5/1991 | McCallister . | |
| 5,078,398 | 1/1992 | Reed et al. . | |
| 5,100,146 | 3/1992 | Antonious . | |
| 5,125,664 | 6/1992 | Evans . | |
| 5,131,656 | 7/1992 | Kinoshita . | |
| 5,167,414 | 12/1992 | Montgomery . | |

FOREIGN PATENT DOCUMENTS

| | | | |
|---|---|---|---|
| 238646 | 10/1960 | Australia | 273/80 C |
| 899562 | 6/1962 | United Kingdom | 273/80 C |

*Primary Examiner*—Vincent Millin
*Assistant Examiner*—Sebastiano Passaniti
*Attorney, Agent, or Firm*—Haugen and Nikolai

[57] ABSTRACT

A golf putter including a hosel offset rearwardly of the ball striking surface such that the entire ball striking surface is visible from above when addressing a golf ball. Further, the golf shaft is angled above and forwardly of an imaginary plane defined by the ball striking surface such that the golfer can keep their hands ahead of the putter head through impact, creating a pulling action to produce overspin on the ball and to allow the face of the putter to remain square to the intended line through impact. The shaft has an extended length to provide stability of the putter head while putting. The golf head includes both heel and toe weighting to provide both statically and dynamically balanced putter head. The head is comprised of stainless steel with a black coated sole plate and hosel such that the polished stainless steel ball striking plate is clearly visible and distinctive in contrast to the remaining head.

10 Claims, 3 Drawing Sheets

10
12
14
16
18
20
22
24
28
30
32
34
36
40
42
46
48
50
52
54
4
5
A
D

GOLF PUTTER

Field of the Invention

This invention is related generally to golf equipment, and more particularly, to a golf putter.

BACKGROUND OF THE INVENTION

Golf enthusiasts, both amateur and professional, are always seeking improved golf equipment. Whether its an improved golf ball with unique dimple designs to lengthen and control the flight of drives, balanced perimeter weighted irons to compensate for improper golf swings, or balanced putter heads to help a golfer achieve a better putting stroke, new and better golf equipment enters the sports scene each year which promises to improve scores and reduce handicaps. Perhaps no slogan is better known than the phrase "drive for show, putt for dough". Arguably, most tournaments are won on the putting greens, and perhaps this is best exemplified in the annual golf Skins tournaments where several hundred thousand dollars may be on the line on a single putt.

Golf equipment is usually primarily designed based on physics to control inertia to attain the ideal performance club. However, physical and aesthetic appearance can be equally important thus giving the golfer the confidence in the club to make great shots. Most golfers will agree that if the club doesn't look like it is precision designed and manufactured, it just won't feel right thus making the golfer inclined to find another piece of equipment. Thus, both physical attributes, as well as engineered attributes, together give the golfer the confidence and the ability to use the equipment and achieve better scores.

Perhaps no golf club is more revered than the golf putter. In fact, many golfers will bestow the putter with a name, and even talk and address the golf putter, as well as the Holy One above, when attempting those crucial putts. Special protective gloves or socks are often used to protect one's most cherished putter. Even the simplest of putters, namely, a shaft and a plain copper bar serving as the golf head, can be the perfect putter for one's game.

But aesthetics are not all that gives the golfer confidence to make putts and great scores. Balancing of the putter head is important such that inertia is controlled and one can consistently address and stroke the ball properly to make straight putts. The putter head is typically precision weighted to reduce torquing the putter head while putting. This can include weighting the putter head at the toe and heel, along the mid-section thereof, and manufacturing the putter head with multiple types of material each having different densities to achieve the best possible balanced head.

Since the sport of golf originated in England over a hundred years ago, many putter heads have been designed. While balancing the putter head has always been considered important, the ability to visually see the golf ball while both addressing and stroking is another pair of important considerations. Indicia is commonly defined on the putter to help the golfer align the striking face such that the sweet spot will strike the ball during a putt. Many designs also include uniquely designed and positioned hosels which couple the putter shaft to the putter head and which are integral to the balancing of the putter head.

However, most hosels are coupled to the putter head proximate the front ball striking surface of the putter, and thus, visually interfere with the golfer's ability to see the ball, both while addressing and putting the golf ball. Thus, the golfer's vision can become impaired, which degrades both the performance and confidence of the golfer and which can account for higher golf scores. USGA golf rules also dictate the acceptable putter designs which are approved for competitive play. One rule requires that the putter shaft tapers at at least a 10 degree angle starting no more than five inches above the bottom sole surface of the putter in the plane defined by the heel and the toe of the putter. Thus, many designed considerations come into play when designing the ultimate putter.

While many golf putters are available on the market today, none that the inventor is aware of provides a golf putter with a static and dynamically balanced putter head, which provides a ball striking surface which is entirely visible from above when addressing and putting the golf ball, and which provides a shaft allowing complete visibility of the ball and the ball striking surface while facilitating stability of the putter head.

OBJECTS

Accordingly it is a principle object of the present invention to provide a golf putter having a ball striking surface which is entirely visible from above when addressing and putting the golf ball.

It is a further object of the present invention to provide a golf putter which is both statically and dynamically balanced to control inertia thus reducing the chance of torquing the putter head, and thus facilitates achieving straighter putts.

Still yet a further object of the present invention is to provide a putter head which has a center of mass defined to help achieve top spin when striking the golf ball, thus helping the golfer achieve putts of consistently predictable distances.

It is a further object of the present invention to provide a putter having a shaft allowing complete visibility of the ball striking surface while facilitating stability of the putter head.

Other objects, features and advantages of the present invention will become apparent to those skilled in the art through the Description of the Preferred Embodiment, Claims, and drawings herein.

SUMMARY OF THE INVENTION

The foregoing objects and advantages are achieved by providing a golf putter including a hosel which is positioned offset from the front ball striking surface and defined rearwardly thereof to facilitate viewing the entire ball striking surface when viewed from thereabove. Further, the putter shaft is bent slightly above the hosel such that the shaft angles forwardly with a portion defined above and forward of an imaginary plane defined by the ball striking surface. This feature also allows the entire ball striking surface to be viewed from above, and further allows the golfer to keep their hands ahead of the putter head through impact, thus allowing the golfer to pull the ball and achieve top spin. The shaft has an extended length which can be rested against the golfer's forearm to achieve stability of the putter head. Finally, the putter head includes both heel and toe weights to help achieve both static and dynamic balancing of the putter head.

Specifically, the invention includes a putter head having a front member including a lower portion and a front ball striking surface. The putter head further includes a generally horizontally oriented elongated sole plate rigidly secured to the front member lower portion and extending rearwardly thereof to define an L-shape. The sole plate includes a heel and toe portion with an intermediate portion extending therebetween, wherein the thickness of both the heel and toe portions is greater than the intermediate portion and to define a heel and the weight, respectively. A hosel is rigidly secured at a first securing point to the heel portion of the sole plate, and preferably the heel weight and extends upwardly therefrom. The first securing point where the hosel attaches to the heel portion is offset a preselected distance rearward of the front ball striking surface of the putter head such that the entire front ball striking surface is visible from above when addressing and putting the ball. The putter includes an extra long shaft rigidly secured to an upper portion of the hosel and extends upwardly therefrom, and which can extend along a golfer's forearm. The shaft is further characterized in having a bend defined a predetermined distance above the hosel such that a portion of the shaft defined above the bend is angled forwardly, above and in front of an imaginary vertical plane extending upwardly from the putter head ball striking surface.

In the preferred embodiment the putter also includes an impact mark defined on the top of the sole plate proximate the center of mass and which identifies the sweet spot of the putter head. Preferably, the hosel is attached to the heel weight of the putter head. In the preferred embodiment, the hosel extends from the heel weight upwardly at approximately a 41 degree angle with respect to a horizontal reference. At the bend of the hosel, the hosel then extends upwardly at approximately an 18 degree angle from a vertical reference line. Similarly, the putter shaft extends upwardly at approximately 18 degrees with respect to this vertical line, and then is bent forward of the ball striking surface at approximately a 10 degree angle with respect to an imaginary vertical plane defined by the ball striking surface. Also at this bend the shaft angles upwardly at a 10 degree angle with respect to a vertical line.

DESCRIPTION OF THE PREFERRED EMBODIMENT

Figure 1:
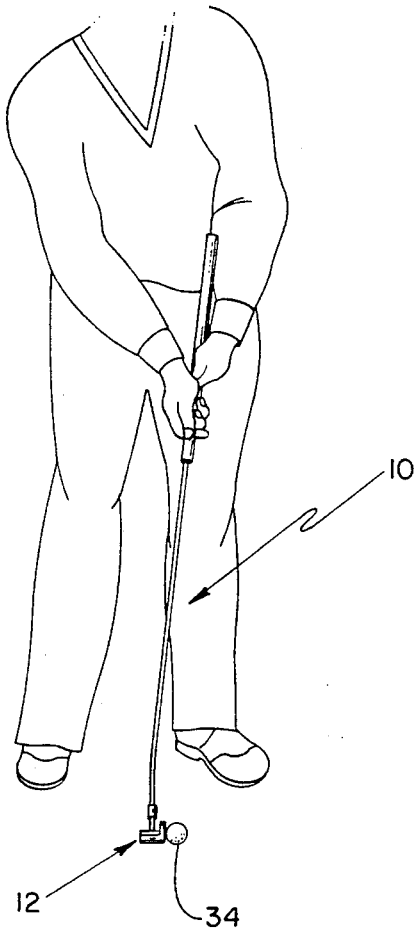
FIG. 1 is a front elevational view of a golfer holding the putter according to the preferred embodiment of the invention and addressing a golf ball.
Figure 2:
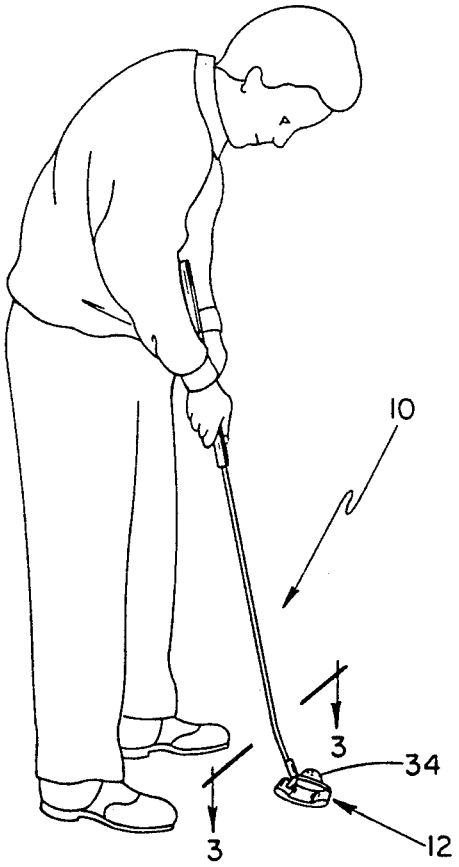
FIG. 2 is a rear elevational view of the golfer addressing a golf ball with the putter of the present invention.

Referring now to FIG. 1, a golf putter according to the preferred embodiment of the present invention is shown at 10 being held by a golfer addressing a golf ball. In FIG. 1 some of the principle features of the present invention are shown, namely, a golf putter with a hosel offset rearwardly at the ball striking surface such that the entire ball striking surface is visible from above while addressing the golf ball, and further, wherein a portion of the shaft is angled forwardly of an imaginary plane defined by the ball striking surface to help insure visibility and to facilitate holding the hands forwardly of the golf ball to allow pulling when stroking to obtain top spin. Also shown in FIG. 1 is an extended shaft which rests upon the forearm of the golfer to facilitate stability of the shaft and putter head while stroking and striking the ball. FIG. 2 illustrates a rear elevational view to further illustrate at the proper grip and usage of golf putter 10 according to the preferred embodiment of the invention.

Figures 3, 4, 5:
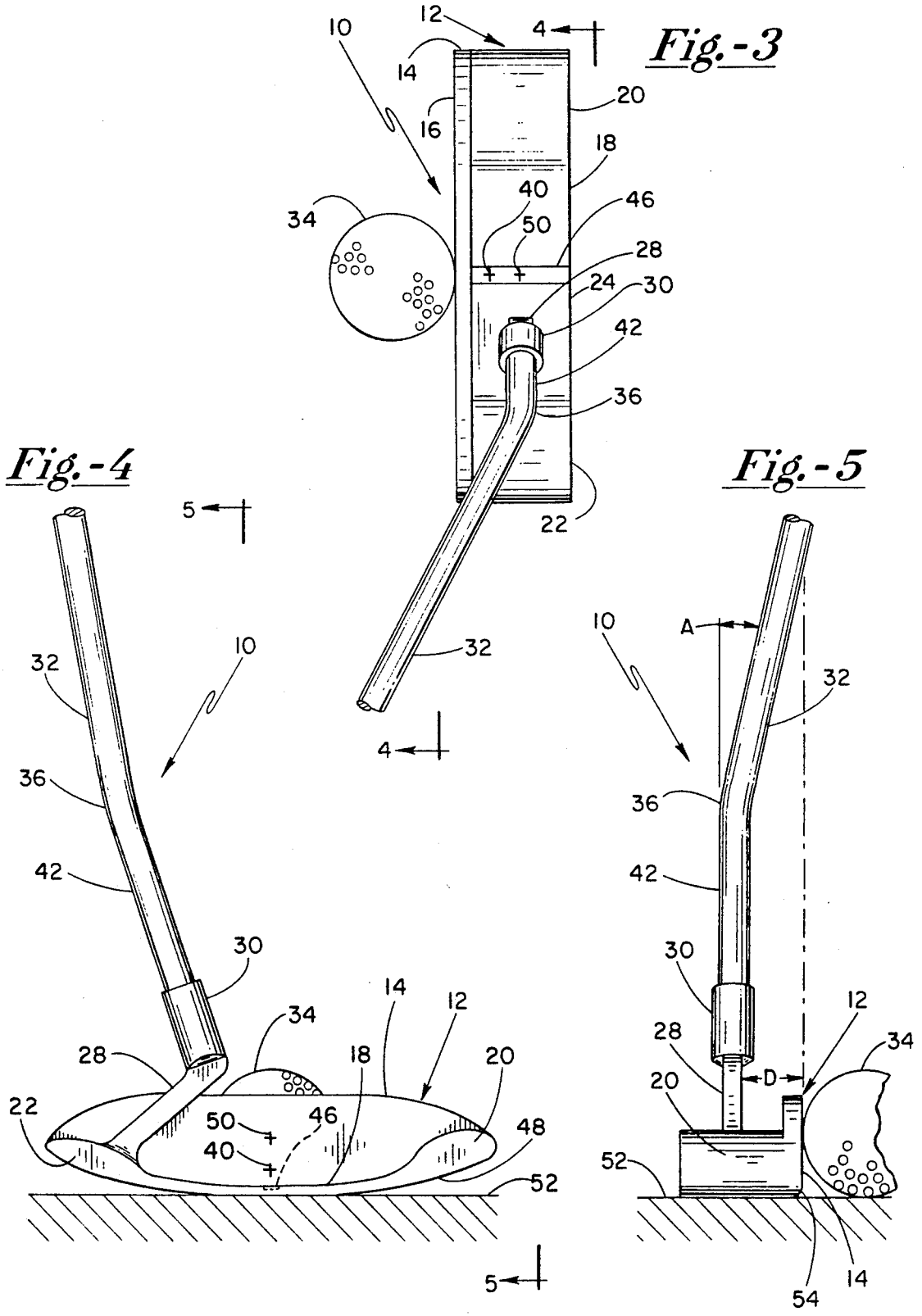
FIG. 3 is a top view 3—3 shown in FIG. 2 illustrating the putter head of the present invention addressing the golf ball wherein the entire ball striking surface is visible from above both when addressing and striking the ball, and further, illustrates the shaft bent forward of the ball striking surface to allow seeing the ball striking surface and to facilitate stroking and pulling the ball to induce top spin.
FIG. 4 is a side view 4—4 shown in FIG. 3 illustrating the heel and toe weights wherein the hosel extends upwardly from the rear heel weight and is then bent and coupled to the lower end of the shaft.
FIG. 5 is an end view 5—5 shown in FIG. 4 illustrating a portion of the club shaft bent forward of the imaginary plane defined by the ball striking surface, and further, illustrating the ball in relation to the ball striking surface and which makes contact with a top portion thereof when the putter head is rested on the putting surface behind the ball.

Referring now to FIG. 3, a top view 3—3 shown in FIG. 2 is shown to better illustrate the principle features of the preferred embodiment of the invention. As clearly shown, putter 10 includes a head 12 comprised of a rigid vertically oriented front plate 14 defining a front ball striking surface 16, and the bottom horizontally oriented sole plate 18 rigidly secured along a bottom portion of front plate 14 and extending rearwardly thereof to define an L-shape head 12. Sole plate 18 is further characterized in having a toe weight 20 at a toe portion and a heel weight 22 at a heel portion with a mid-section 24 extending therebetween. A bent hosel 28 is rigidly secured to heel weight 22 and extends upwardly therefrom at an angle to a coupling sleeve member 30 which securingly receives a shaft 32 therein as shown.

A first distinctive feature of the present golf putter is that hosel 28 is secured to heel weight 22 at a mid-section thereof and is offset rearwardly of front plate 14 and ball striking surface 16. Thus, as shown, the entire ball striking front surface 16 is visible from above when addressing golf ball 34 and while putting, thus helping the golfer achieve more accurate putts.

A second distinctive feature of the present invention is that shaft 32 initially extends upwardly from golf head 12 at an angle away from a vertical reference center and along an imaginary line extending from toe weight 20 to heel weight 22, and then bent at 36 over, and forward of an imaginary plane defined by ball striking surface 16. Thus, some and preferably a majority of shaft 32 extends forward of the imaginary plane defined by ball striking surface 16 to allow the golfer a full view of the golf ball 34 while addressing and striking, and also facilitates holding one's hands forward of the ball striking surface such that one can pull the ball while stroking to induce top spin. However, it is adequate for some golfers that shaft 32 only extend forward and above plate 14 and terminating in the imaginary plane. These two principle features, namely, offsetting the hosel rearwardly and bending the shaft forwardly are together accomplished while still providing a balanced head which is both statically and dynamically balanced with a low center of mass, as will now be discussed in regards to FIG. 4.

Referring now to FIG. 4, a more detailed discussion of the physical attributes of golf putter 10 and head 12 will be discussed. A center of mass 40 is shown which is defined by front plate 14, sole plate 18 which includes toe weight 20 and heel weight 22, and hosel 28. The orientation and thicknesses heel weight 22 and toe weight 20, in combination with the shape of hosel 28 provides for a head 12 that is both statically and dynamically balanced while striking the ball. This balancing is achieved by the heel weight 22 and toe weight 20 providing inertia while striking the ball which resists one's wrists inadvertently altering the plane of ball striking surface 16 while putting. This inertia inhibits the tendency to rotate the ball striking surface is further achieved by designing the mid-section of sole plate 18 with a relatively thin thickness compared to the large thicknesses of heel weight 22 and toe weight 20 which form an integral portion of sole plate 18. The large heel and toe weights provide mass a sufficient distance each side of center of mass 40, as shown. Thus, it is more difficult for the golfer to create a moment about the center of mass 40 which could cause rotation which could result in ball 34 being stroked in a line other than the line for the intended putt.

Also shown in FIG. 4 is the lower portion of hosel 28 extending upwardly and forwardly from heel weight 22 above a mid-section of sole plate 18 to help define center of mass 40 very proximate a geographical center 50 head 12. Indicia 46 (see FIG. 3) is defined in a top surface of sole plate 18 proximate center of mass 40 and the geographical center of sole plate 18 to indicate the sweet spot of the putter head 12 and which is used for aligning ball striking surface 16 with the ball 34 while aiming.

Also shown in FIG. 4 is geographical center 50. Geographical center 50 is defined as the midsection in the longitudinal and lateral direction of golf head 12. As shown, center of mass 40 is defined slightly below geographical center 50 which helps initiate top spin when striking the ball. By designing the center of mass 40 closely proximate the geographical center 50 as shown, the ball 34 is addressed closely proximate the geographical center of ball striking surface 16 which is a natural and comfortable alignment for the golfer while putting. The top surface of front plate 14 is tapered downwardly at each end toward the respective heel or toe weight, as shown. This tapering feature also facilitates creating the center of mass 40 below the geographical center 50. It also facilitates an aesthetically pleasant golf head 12.

As shown in FIG. 4, toe weight 20 has a slightly greater thickness and mass than the heel weight 22. These weight thicknesses are chosen to help create a center of mass 40 closely proximate the geographical center 50. Thus, hosel 28 in combination with the heel weight 22 and the toe weight 20 defines the center of mass 40, as shown. Both heel weight 22 and toe weight 20 have curved upper surfaces to provide an aesthetically pleasant and continuous upper surface. The bottom surface 48 of sole plate 18 is arcuate and curved upwardly such that bottom surface 48 makes a tangental contact when rested upon ground surface 52. This design minimizes the friction which can result when bottom surface 48 engages the putting green during putting and provides a slippery feel when striking ball 34. As shown the top surface of sole 18 extending between heel weight 22 and toe weight 20 is also curved and conforms to the curvature of bottom surface 48 such that the radii defining each curve are concentric.

In the preferred embodiment, the sole plate 18 is very thin relative to the overall head 12 and has a thickness of about 3/16 inches at center. Heel weight 22 has a thickness at center of about ⅜ inches, and toe weight 20 has a thickness at center of about ½ inches. Thus, a majority of the sole plate mass is at the heel and toe of head 12 to provide very good control of inertia and gives the golfer a good feel of control while putting.

Referring now to FIG. 5, an end view 5—5 shown in FIG. 4 is shown to illustrate the upper section of shaft 32 extending above and forwardly of an imaginary plane defined by the ball striking surface 16 of plate 14. FIG. 5 also illustrates hosel 28 extending upwardly from a central portion of heel weight 22 and offset a distance D rearward of ball striking surface 14. Again, this offset distance D facilitates providing a full view of front plate 14 when viewed above, both when addressing the ball and when putting the ball. Also shown in FIG. 5 is angle "A" which is defined by the upper portion of shaft 32 extending forward from a vertical reference line, such as defined by hosel 18 and the lower portion 42 of shaft 32. Preferably, angle A is approximately 10 degrees. Putter head 12 also has a rounded leading edge 54 to reduce the likelihood of stubbing head 12 on the putting surface while putting.

Figure 6:
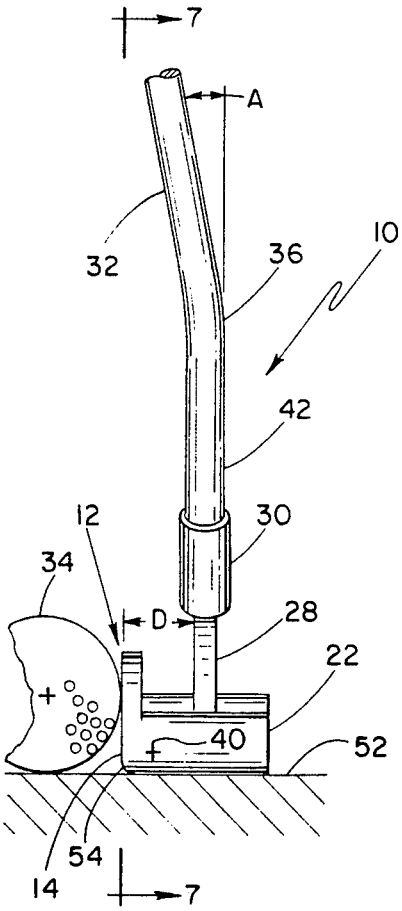
FIG. 6 is an end view taken from where the golfer would stand illustrating the relationship of the ball striking surface to the ball, and further, illustrating the hosel extending upwardly from the heel weight, wherein the club shaft is bent forwardly of the ball striking surface.

Referring now to FIG. 6, a rear end view of putter 10 is shown oriented behind the ball from the player's perspective. This view also illustrates hosel 28 extending upwardly from a mid-section of heel weight 22 offset a predetermined distance D behind ball striking surface 16. It is noted in FIG. 6, bend 36 is defined no more than five inches above ground 52 to comply with USGA golf rules. Also shown in FIG. 6 is front plate 12 extending slightly above a mid-line of golf ball 34 when putter head 12 is rested on the putting surface where ball 34 defines a tangental contact with ball striking surface 16 as shown.

Further shown in FIG. 6 is center of mass 40 which is defined below a mid-line of ball 34 to facilitate top spin when stroking ball 34. If desired, front ball striking surface 16 could be curved outwardly slightly to further facilitate top spin when putting ball 34.

Figure 7:
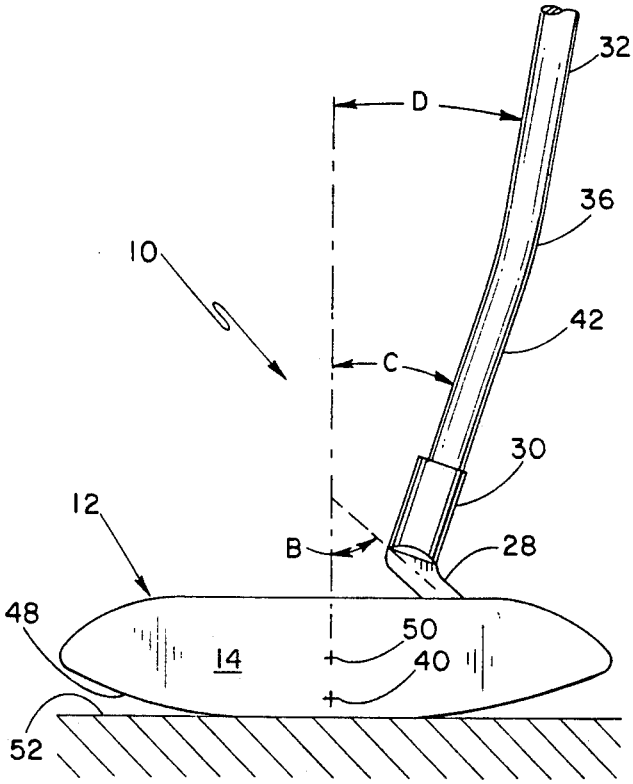
FIG. 7 is a front view 7—7 shown in FIG. 6 illustrating the ball striking surface and the angle at which the shaft extends, both above and below the bend.

Referring now to FIG. 7, a front view 7—7 shown in FIG. 6 is shown to illustrate ball striking surface 16 of head 12. Further illustrated in FIG. 7 is angle B which is defined by an imaginary axis extending through the lower portion of hosel 18 in reference to a vertical line. Preferably, angle B is 49 degrees although angles between 35 and 60 degrees are acceptable to define acceptable centers of mass 40. The upper part of hosel 28 defines an angle C with respect to a vertical reference, as shown, which is preferably 18 degrees. The upper portion of shaft 32 above bend 36 defines an imaginary axis defining an angle D with respect to a vertical reference, wherein D is preferably 10 degrees. However, it is specifically noted angles A, B, C and D are all set forth as the preferable angular dimensions, and limitations to these preferred angles is not to be inferred.

Head 12, including front plate 14 and sole 18 are all preferably comprised of stainless steel, and thus of a single material having a uniform density. This provides for a head 12 which is easy to manufacture, aesthetically pleasant in appearance, and which is resilient to rusting. Preferably, the top surface of sole plate 18 is finished with a durable flat black coating, as is hosel 28. The top surface and ball striking surface of plate 14 are sandblasted to minimize reflection of light and have a matte finish, and the remaining portions of the sole plate 18 are polished to provide an attractive golf putter head. From above, the top surface of plate 14 will be silver in appearance and contrasts the remaining visible black portions of sole 18 and hosel 28. This entire sandblasted stainless steel surface is visible from above while addressing the ball and while putting the ball, as previously discussed. Hence, the golfer also finds indicia 46 in ball striking surface 14 easy to locate while addressing and putting the ball. This reduces eye strain and improves concentration to help the golfer make a crucial putt.

In summary, the unique golf putter as taught and disclosed according to the preferred embodiment of the present invention provides several unique features in a single embodiment. These features in combination provide a golf putter with a fully visible ball striking surface, which has a shaft extending above and forward of an imaginary plane defined by the ball striking surface such that the golfer can orient the hands forward of the surface to allow pulling the ball and to create top spin while putting, and which incorporates toe and heel weighting to both statically and dynamically balance the golf head to reduce torquing. The extended shaft allows the golfer to rest the shaft against the golfer's forearm for added stability of the putter head. Together, all these features allow the golfer to achieve a one-piece shoulder/arm/hand connection while putting. While prior art putters may attempt to achieve some of these features standing alone, no one prior art putter is believed to include these features in combination to achieve all the desired results while still obtaining a dynamically and statically balanced putter head. The present invention allows the golfer to clearly address the golf ball with the putting surface, thus allowing the golfer to aim the ball along an intended line. Balancing is not sacrificed, and further, top spin is facilitated. As a whole, the present invention gives the golfer confidence, the feel of a quality golf club, and the performance of a precision engineered design to attain maximum performance. This confidence and performance will help a golfer consistently achieve lower scores on the course.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A golf putter, comprising:

(a) a putter head having a front member including a lower portion and a front plate having a front ball striking surface, said putter head further including a generally horizontally oriented elongated sole plate rigidly secured to said front member lower portion and extending rearwardly of said front member, said sole plate having a heel and a toe portion with an intermediate portion extending therebetween, wherein the thickness of both said heel and toe portions is greater than said intermediate portion to define a heel and toe weight, respectively;

(b) a hosel rigidly secured at a first securing point to said sole plate heel portion and extending upwardly therefrom, said first securing point offset a preselected distance rearward of said front member ball striking surface; and (c) a shaft rigidly secured to an upper portion of said hosel and extending upward therefrom at a first angle with respect to a vertical reference, said shaft characterized in having a bend defined a predetermined distance above said hosel wherein a portion of the shaft defined above said bend is angled forwardly and intersects an imaginary vertical plane extending upwardly from said front member ball striking surface.

2. The putter as specified in claim 1 wherein a portion of the shaft defined above the bend is angled forwardly and in front of the imaginary vertical plane extending upwardly from the front member ball striking surface.

3. The putter as specified in claim 2 wherein said front member has an impact mark defined proximate of the center of mass.

4. The putter as specified in claim 1 wherein said hosel is securingly attached to said heel weight.

5. The putter as specified in claim 1 wherein said shaft extends above said bend at a second angle different from first angle with respect to a vertical reference.

6. The putter as specified in claim 5 wherein said first angle is greater than said second angle in reference to a vertical reference.

7. The putter as specified in claim wherein said toe weight has a greater mass than said heel weight.

8. The putter as specified in claim 1 wherein said front plate has a pair of ends each tapering downwardly to define a center of mass closely proximate a bottom of said putter head.

9. The putter as specified in claim 1 wherein said front plate has a different color than said sole plate when viewed from above to contrast the front plate from the sole plate to help visually ascertain the ball striking surface while addressing a golf ball.

10. The putter as specified in claim 1 wherein said hosel extends upwardly from said heel portion at an angle between 35 and 60 degrees with respect to a horizontal reference.

* * * * *

UNITED STATES PATENT AND TRADEMARK OFFICE

CERTIFICATE OF CORRECTION

PATENT NO. : 5,308,068

DATED : May 3, 1994

INVENTOR(S) : Allan M. Strand

It is certified that error appears in the above-indentified patent and that said Letters Patent is hereby corrected as shown below:

In column 8, line 41, the phrase

"a second angle different from"

should read

-- a second angle different from said --;

In column 8, line 46, the phrase

"as specified in claim"

should read

-- as specified in claim 1 --.

Signed and Sealed this

Second Day of August, 1994

*Attest:*

*Attesting Officer*

BRUCE LEHMAN

*Commissioner of Patents and Trademarks*